US007210765B2

(12) United States Patent
Furukawa

(10) Patent No.: US 7,210,765 B2
(45) Date of Patent: May 1, 2007

(54) INK JET HEAD AND INK JET RECORDER

(75) Inventor: Koji Furukawa, Shizuoka (JP)

(73) Assignee: Fujifilm Corp., Tokyo (JP)

( * ) Notice: Subject to any disclaimer, the term of this patent is extended or adjusted under 35 U.S.C. 154(b) by 228 days.

(21) Appl. No.: 10/886,034

(22) Filed: Jul. 8, 2004

(65) Prior Publication Data

US 2005/0007422 A1 Jan. 13, 2005

(30) Foreign Application Priority Data

Jul. 11, 2003 (JP) ..... 2003-195594

(51) Int. Cl.
*B41J 2/06* (2006.01)

(52) U.S. Cl. ..... 347/55

(58) Field of Classification Search ..... 347/9, 347/54, 55

See application file for complete search history.

(56) References Cited

U.S. PATENT DOCUMENTS 4,263,601 A 4/1981 Nishimura et al.
4,333,086 A * 6/1982 Ebi ..... 347/55
6,158,844 A 12/2000 Murakami et al.

FOREIGN PATENT DOCUMENTS

JP 10-138493 A 5/1998
WO WO 99/32298 A2 7/1999
WO WO 01/47715 A1 7/2001

OTHER PUBLICATIONS

"Electropotography-Bases and Applications", edited by the Imaging Society of Japan, and published by Corona Publishing Co., Ltd., pp. 497-505, 1988.

* cited by examiner

*Primary Examiner*—An H. Do
(74) *Attorney, Agent, or Firm*—Sughrue Mion, PLLC

(57) ABSTRACT

The ink jet recorder serves to record an image corresponding to image data on a recording medium using the ink jet head which discharges ink containing colored fine particles. The ink jet head includes a discharge opening substrate through which discharge openings through which the ink is discharged are bored, a head substrate which is disposed at a predetermined distance from the discharge opening substrate so as to define an ink passage between the discharge opening substrate and the head substrate, and a discharge control portion which controls the discharge of the ink through the discharge openings. An ink guide groove is formed in a surface of the discharge opening substrate on a side of the ink passage so as to lead from an upstream side of an ink flow to the discharge opening.

16 Claims, 8 Drawing Sheets

INK JET HEAD AND INK JET RECORDER

BACKGROUND OF THE INVENTION

The present invention relates to an ink jet head for discharging ink containing colored fine particles to record an image corresponding to image data on a recording medium, and to an ink jet recorder using the ink jet head.

An ink jet recorder serves to discharge ink containing colored fine particles through discharge openings to record an image corresponding to image data on a recording medium. Examples of known ink jet recorders include an electrostatic type, thermal type, and piezo type ink jet recorders which are classified depending on differences of means for controlling discharge of ink.

Hereinafter, the electrostatic type ink jet recorder will be described as an example. The electrostatic type ink jet recorder is such that ink containing colored fine particles charged with electricity is used, and predetermined voltages are respectively applied to discharge portions of an ink jet head in correspondence to image data, whereby discharge of the ink from the ink jet head is controlled by utilizing electrostatic forces to record an image corresponding to the image data on a recording medium. Known as an example of the electrostatic type ink jet recorder is an ink jet recorder disclosed in JP 10-138493 A.

FIG. 10 is a schematic view showing a construction of an example of an ink jet head of an electrostatic type ink jet recorder disclosed in JP 10-138493 A. In an ink jet head 80 shown in the figure, only one discharge portion of the ink jet head disclosed in JP 10-138493 A is conceptually shown. The ink jet head 80 includes a head substrate 82, an ink guide 84, an insulating substrate 86, a control electrode 88, a counter electrode 90, a D.C. bias voltage source 92, and a pulse voltage source 94.

Here, the ink guide 84 is disposed on the head substrate 82, and a through hole (discharge opening) 96 is bored through the insulating substrate 86 so as to correspond in position to the ink guide 84. The ink guide 84 extends through the through hole 96, and its convex tip portion 84*a* projects upwardly and beyond a surface of the insulating substrate 86 on a side of a recording medium P. In addition, the head substrate 82 is disposed at a predetermined distance from the insulating substrate 86. Thus, a passage 98 of ink Q is defined between the head substrate 82 and the insulating substrate 86.

The control electrode 88 is provided in a ring-like shape on the surface of the insulating substrate 86 on the side of the recording medium P so as to surround the periphery of the through hole 96 of every discharge portion. In addition, the control electrode 88 is connected to the pulse voltage source 94 for generating a pulse voltage in correspondence to image data. The pulse voltage source 94 is grounded through the D.C. bias voltage source 92.

In addition, the counter electrode 90 is disposed in a position facing the tip portion 84*a* of the ink guide 84 and is grounded. The recording medium P is disposed on a surface of the counter electrode 90 on a side of the ink guide 84. That is to say, the counter electrode 90 functions as a platen for supporting the recording medium P.

During the recording, the ink Q containing fine particles which are charged at the same polarity as that of a voltage applied to the control electrode 88 is made to circulate through the ink passage 98 from the right-hand side to the left-hand side in the figure by a circulation mechanism for ink (not shown). In addition, a high voltage of 1.5 kV for example is usually applied to the control electrode 88 by the D.C. bias voltage source 92. At this time, part of the ink Q within the ink passage 98 passes through the through hole 96 of the insulating substrate 86 by a capillary phenomenon or the like to be concentrated at the tip portion 84*a* of the ink guide 84.

If a pulse voltage of 0 V for example is applied from the pulse voltage source 94 to the control electrode 88 biased at 1.5 kV by the bias voltage source 92, then a voltage of 1.5 kV obtained by superposing both the voltages on each other is applied to the control electrode 88. In this state, an electric field strength in the vicinity of the tip portion 84*a* of the ink guide 84 is relatively low, and hence the ink Q containing the charged fine particles which are concentrated at the tip portion 84*a* of the ink guide 84 is not flied out from the tip portion 84*a* of the ink guide 84.

On the other hand, if a pulse voltage of 500 V for example is applied from the pulse voltage source 94 to the control electrode 88 biased at 1.5 kV, then a voltage of 2 kV obtained by superposing both the voltages on each other is applied to the control electrode 88. As a result, the ink Q containing the charged fine particles which are concentrated at the chip portion 84*a* of the ink guide 84 is flied but in a form of an ink droplet R from the tip portion 84*a* of the ink guide 84 by the electrostatic force to be electrostatically drawn by the grounded counter electrode 90 to be stuck onto the recording medium P to form thereon a dot of the charged fine particles.

In such a manner, a recording is carried out with the dots of the charged fine particles while the ink jet head 80 and the recording medium P supported on the counter electrode 90 are relatively moved to thereby record an image corresponding to the image data on the recording medium P.

Now, in the electrostatic type ink jet head, when a plurality of discharge portions are disposed in a matrix to construct a multi-channel head, it becomes gradually difficult to connect signal wirings to the control electrodes for the respective discharge portions. For this reason, in the case where there is a large number of channels, it is conceivable that the insulating substrate is made in the form of a multilayer wiring structure in order to connect signal wirings to control electrodes. Consequently, in the future, the insulating substrate has a tendency to become gradually thicker along with an increase in the number of channels.

However, since a length of the through hole becomes larger than an opening diameter thereof if the insulating substrate is thickened, a resistance between the ink and an inner wall of the through hole becomes large and hence the ink becomes hard to be discharged. In addition, if the insulating substrate is thickened as compared with a velocity of an ink flow, then the ink stays in the through hole to degrade the property of supply of the ink to the tip portion of the ink guide. As a result, there is encountered a problem that a responsibility at the discharge frequency becomes poor, and hence the dot diameter gradually becomes smaller as the drawing speed is further increased.

Note that while not limited to the electrostatic type ink jet recorder, when the insulating substrate is thickened, i.e., the length of the through hole becomes large, the same problem occurs in the ink jet recorders using the various type ink jet heads.

SUMMARY OF THE INVENTION

In order to solve above-mentioned problems associated with the prior art, an object of the present invention is to provide an ink jet head which is capable of enhancing a property of supply of ink to discharge openings, and of, even when dots are continuously drawn at a high speed, stably drawing the dots each having a desired size, and an ink jet recorder using the ink jet head.

In order to achieve the above-mentioned object, the present invention provides an ink jet head for discharging ink containing colored fine particles to record an image corresponding to image data on a recording medium, the ink jet head comprising: a discharge opening substrate through which discharge openings are bored, said ink being discharged through said discharge openings; a head substrate disposed at a predetermined distance from said discharge opening substrate so as to define an ink passage between said discharge opening substrate and said head substrate; and discharge control means for controlling the discharge of said ink through said discharge openings, wherein an ink guide groove is formed in a surface of said discharge opening substrate on a side of said ink passage so as to lead from an upstream side of an ink flow to said discharge opening.

Preferably, said ink jet head is an electrostatic type ink jet head for discharging ink containing charged and colored fine particles by utilizing an electrostatic force to record an image corresponding to image data on a recording medium, said discharge opening substrate includes at least: an insulating substrate; a ring-like control electrode of at least one layer formed on a surface of said insulating substrate on a side of said ink passage and/or a side of said recording medium so as to surround a periphery of said discharge opening; and an insulating layer of at least one layer for covering surfaces of said insulating substrate and said control electrode, and said ink guide groove is formed in the surface of said discharge opening substrate on the side of said ink passage.

Preferably, said control electrode is formed into a circular arc shape with its part on the upstream side of said ink flow being removed, and said ink guide groove is formed so as to extend through said removed portion of said control electrode to reach in depth the layer on a side of said recording medium through the control electrode formed nearest the side of said recording medium.

Preferably, said ink guide groove is sloped at a predetermined angle so that its depth becomes gradually deeper from the upstream side of said ink flow to said discharge opening.

Preferably, a length of said ink guide groove is 6 or more times as large as the depth of said ink guide groove.

Preferably, said ink guide groove is formed so that its width becomes nearly equal to a diameter of said discharge opening, or becomes narrower towards the upstream side of said ink flow, or becomes narrower towards said discharge opening.

Preferably, said ink guide groove is formed so that its depth becomes gradually narrower in cross sectional shape as its depth becomes deeper.

Preferably, said ink guide groove is constituted by a plurality of grooves formed so as to lead to said discharge opening.

Also, the present invention provides an ink jet recorder using an ink jet head for discharging ink containing colored fine particles to record an image corresponding to image data on a recording medium, wherein said ink jet head includes: a discharge opening substrate through which discharge openings are bored, said ink being discharged through said discharge openings; a head substrate disposed at a predetermined distance from said discharge opening substrate so as to define an ink passage between said discharge opening substrate and said head substrate; and discharge control means for controlling the discharge of said ink through said discharge openings, and wherein an ink guide groove is formed in a surface of said discharge opening substrate on a side of said ink passage so as to lead from an upstream side of an ink flow to said discharge opening.

Preferably, said ink jet head is an electrostatic type ink jet head for discharging ink containing charged and colored fine particles by utilizing an electrostatic force to record an image corresponding to image data on a recording medium, said discharge opening substrate includes at least: an insulating substrate; a ring-like control electrode of at least one layer formed on a surface of said insulating substrate on a side of said ink passage and/or a side of said recording medium so as to surround a periphery of said discharge opening; and an insulating layer of at least one layer for covering surfaces of said insulating substrate and said control electrode, and said ink guide groove is formed in the surface of said discharge opening substrate on the side of said ink passage.

Preferably, said control electrode is formed into a circular arc shape with its part on the upstream side of said ink flow being removed, and said ink guide groove is formed so as to extend through said removed portion of said control electrode to reach in depth the layer on a side of said recording medium through the control electrode formed nearest the side of said recording medium.

Preferably, said ink guide groove is sloped at a predetermined angle so that its depth becomes gradually deeper from the upstream side of said ink flow to said discharge opening.

Preferably, a length of said ink guide groove is 6 or more times as large as the depth of said ink guide groove.

Preferably, said ink guide groove is formed so that its width becomes nearly equal to a diameter of said discharge opening, or becomes narrower towards the upstream side of said ink flow, or becomes narrower towards said discharge opening.

Preferably, said ink guide groove is formed so that its depth becomes gradually narrower in cross sectional shape as its depth becomes deeper.

Preferably, said ink guide groove is constituted by a plurality of grooves formed so as to lead to said discharge opening.

This application claims priority on Japanese patent application No.2003-195594, the entire contents of which are hereby incorporated by reference. In addition, the entire contents of literatures cited in this specification are incorporated by reference.

DETAILED DESCRIPTION OF THE INVENTION

An ink jet head and an ink jet recorder of the present invention will hereinafter be described in detail on the basis of preferred embodiments with reference to the accompanying drawings.

Figure 1A:
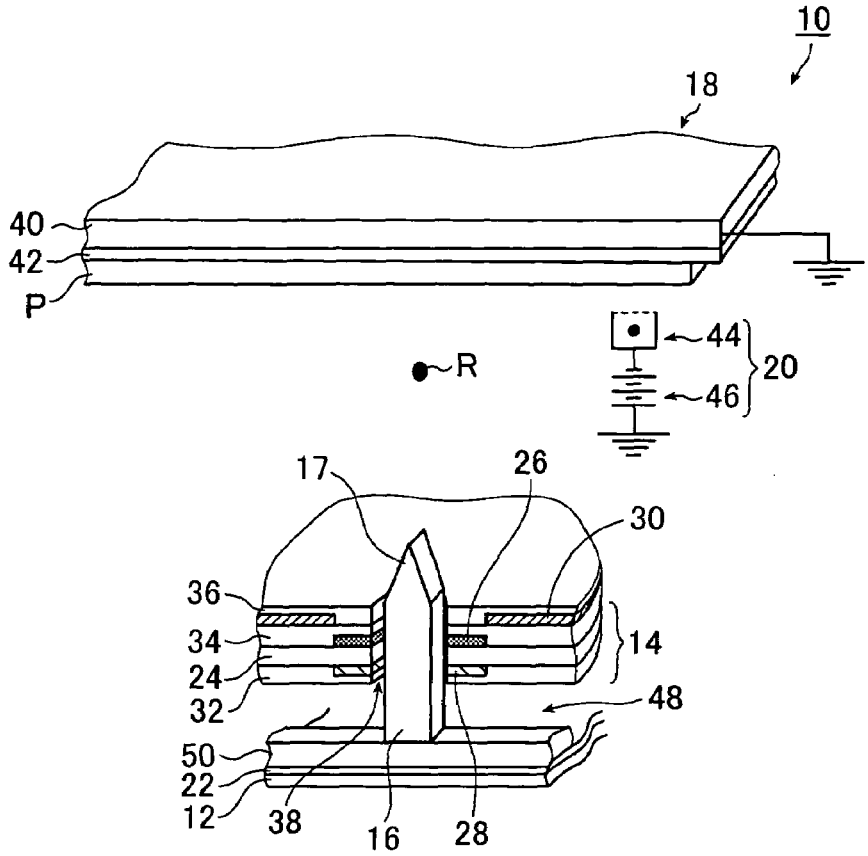
FIGS. 1A and 1B are a perspective schematic view and a structural schematic view each showing a part of an ink jet recorder according to an embodiment of the present invention.
Figure 1B:
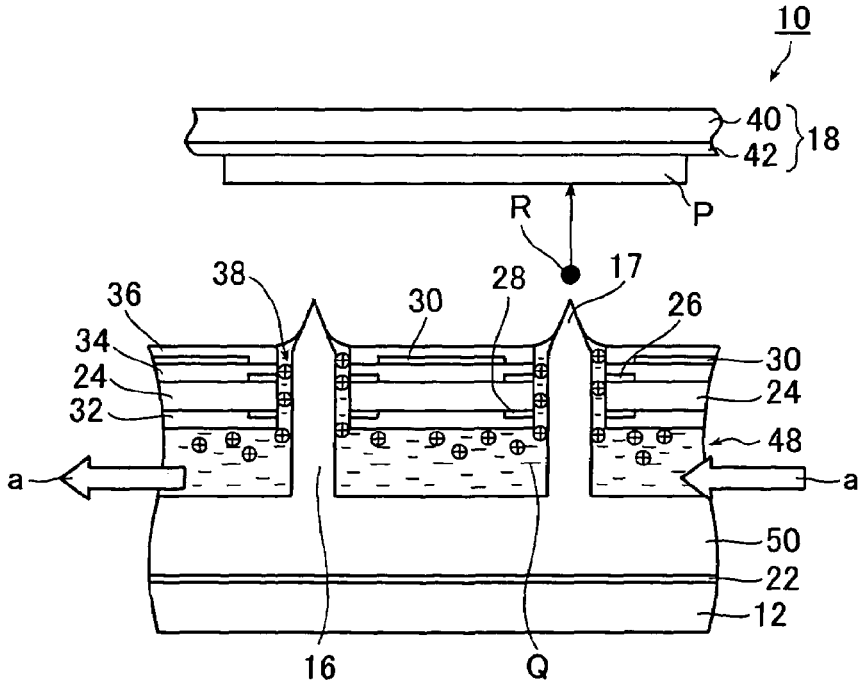

FIGS. 1A and 1B are a perspective schematic view and a structural schematic view each showing a part of an ink jet recorder according to an embodiment of the present invention. An ink jet recorder 10 shown in FIGS. 1A and 1B is an electrostatic type ink jet recorder for recording an image corresponding to image data on a recording medium P using an ink jet head 11 for discharging ink Q containing colored fine particles (e.g., toner) such as a pigment which are charged with electricity in the form of an ink droplet R by utilizing an electrostatic force.

In the figures, in addition to the ink jet head 11, a counter electrode 18 and a charging unit 20 for the recording medium P are shown as a part of constituent elements of the ink jet recorder 10.

Figure 2A:
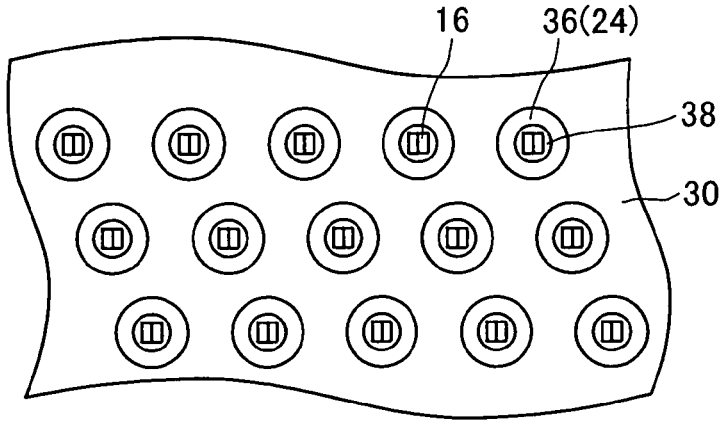
FIGS. 2A, 2B, and 2C are structural schematic views showing states of dispositions of a guard electrode, a second control electrode, and a first control electrode according to an embodiment, respectively.
Figure 2B:
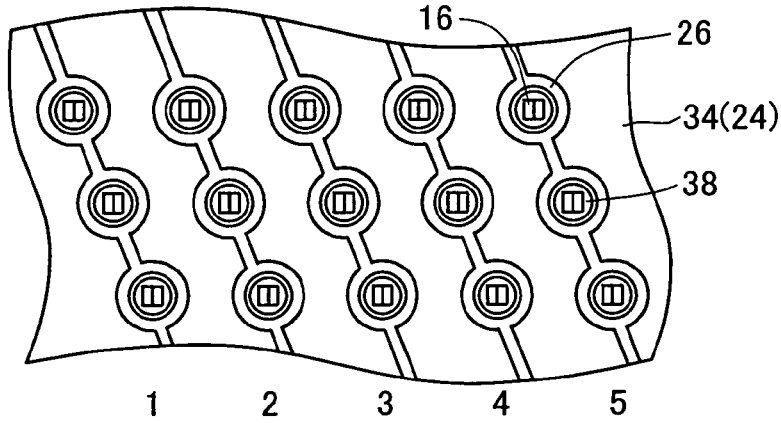
Figure 2C:
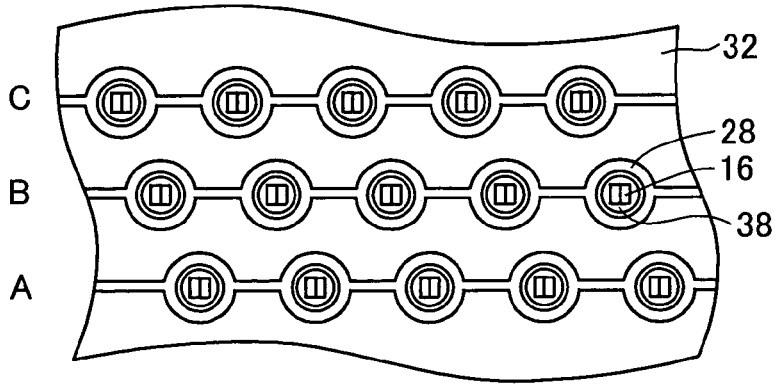

The ink jet head 11 shown in FIGS. 1A and 1B includes a head substrate 12, a discharge opening substrate 14, and an ink guide 16. Note that in order to simplify a description, only one discharge portion of an ink jet head having a multi-channel structure in which as shown in FIGS. 2A to 2C, fifteen discharge portions are two-dimensionally disposed is shown in FIG. 1A, and only two discharge portions are shown in FIG. 1B.

In the ink jet head 11, firstly, the head substrate 12 is a sheet-like insulating substrate common to all the discharge portions, and a floating conductive plate 22 which is electrically in a floating state is formed on a surface of the head substrate 12.

Generated in the floating conductive plate 22 in recording an image is an induced voltage which is induced in correspondence to voltage values of control voltages applied to control electrodes for the discharge portions as will be described later. In addition, a voltage value of the induced voltage automatically changes in correspondence to the number of operating channels. The charged fine particles contained in the ink Q within an ink passage 48 are energized by the floating conductive plate 22 to migrate to a side of the discharge opening substrate 14 to be concentrated at a tip portion 17 of the ink guide 16. For this reason, a concentration of the charged fine particles in the discharged ink Q is usually stabilized at a predetermined concentration.

Note that the floating conductive plate 22 is not an essential constituent element, and hence is preferably provided suitably as may be necessary. In addition, the floating conductive plate 22 has to be disposed on the head substrate 12 side with respect to the ink passage 48. For example, the floating conductive plate 22 may also be disposed inside the head substrate 12. Also, the floating conductive plate 22 is preferably disposed on an upstream side of the ink passage 48 with respect to a position where the discharge portion is disposed. Also, a predetermined voltage may be applied to the floating conductive plate 22.

Next, the discharge opening substrate 14 is also a sheet-like insulating substrate common to all the discharge portions. Through holes (discharge openings for the ink) 38 are bored through the discharge opening substrate 14 in a position corresponding to the ink guide 16 of each discharge portion.

The head substrate 12 is disposed at a predetermined distance from the discharge opening substrate 14. Then, the ink passage 48 through which the ink Q is supplied to the ink guide 16 is defined between the head substrate 12 and the discharge opening substrate 14. The ink Q, while its details will be described later, contains the colored fine particles which are charged at the same polarity as that of the control voltages applied to first and second control electrodes 26 and 28. In recording an image, the ink Q is made to circulate through the ink passage 48 in a predetermined direction and at a predetermined velocity (e.g., at an ink flow of 200 mm/s).

The discharge opening substrate 14 includes an insulating substrate 24, the first control electrode 26, the second control electrode 28, a guard electrode 30, and insulating layers 32, 34, and 36.

The first and second control electrodes 26 and 28 are circular electrodes which are provided in ring-like shapes each on an upper surface and a lower surface of the insulating substrate 24 in the figures so as to surround the periphery of the through holes 38 of each of the discharge portions. The upper surface of the insulating substrate 24 and a surface of the first control electrode 26 are covered with the insulating layer 34 for protecting these surfaces to obtain a flattened surface. Likewise, the lower surface of the insulating substrate 24 and a surface of the second control electrode 28 are covered with the insulating layer 32 for protecting these surfaces to obtain a flattened surface.

Note that neither of the first and second control electrodes 26 and 28 is limited to the ring-like circular electrode, and hence an electrode having any shape such as a nearly circular electrode, a split circular electrode, a parallel electrode, or a nearly parallel electrode may be adopted for each of the first and second control electrodes 26 and 28 as long as the electrode is disposed so as to face the ink guide 16.

As shown in FIGS. 2A to 2C, the fifteen discharge portions are disposed in a matrix shape so that the five discharge portions per row (corresponding to a first column, a second column, a third column, a fourth column, and a fifth column) are disposed in a row direction (in a sub-scanning direction), and the three discharge portions per column (corresponding to an A-th column, a B-th column, and a C-th column) are disposed in a column direction (in a main scanning direction).

As shown in FIG. 2B, the first control electrodes 26 of the three discharge portions disposed in the first column are connected to one another. This is also applied to the second to fifth columns. In addition, as shown in FIG. 2C, the second control electrodes 28 of the five discharge portions disposed in the A-th row are connected to one another. This is also applied to the B-th row and the C-th row. Then, the first and second control electrodes 26 and 28 are connected to control means (not shown) for outputting control voltages corresponding to image data, respectively.

In addition, the five discharge portions belonging to the A-th row are disposed at predetermined intervals in the row direction. This is also applied to the B-th row and the C-th row. Also, the five discharge portions belonging to the B-th row are disposed at a predetermined distance from the five discharge portions belonging to the A-th row in the column direction, and are also disposed between the five discharge portions belonging to the A-th row and the five discharge portions belonging to the C-th row in the row direction. Likewise, the five discharge portions belonging to the C-th row are disposed at a predetermined distance from the five discharge portions belonging to the B-th row in the column direction, and are also disposed between the five discharge portions belonging to the B-th row and the five discharge portions belonging to the A-th row in the row direction.

In such a manner, the five discharge portions contained in each of the A-th row, the B-th row, and the C-th row are disposed so as to be shifted in the row direction, respectively, whereby one row which is recoded on the recording medium P is divided into three parts in the row direction.

In recording an image, the three first control electrodes 26 disposed in the same column are simultaneously driven at the same voltage level. Likewise, the five second control electrodes 28 disposed in the same row are simultaneously driven at the same voltage level. In addition, one row recorded on the recording medium P is divided into three groups corresponding to the numbers of rows of the second control electrodes 28 in the row direction to be successively recorded in a time division manner. For example, in a case of the example shown in FIGS. 2A to 2C, the A-th row, the B-th row, and the C-th row of the second control electrodes 28 are successively recorded to thereby record an image for one row on the recording medium P.

Note that the structure of the control electrodes is not limited to the two-layer electrode structure having the first and second control electrodes 26 and 28, and hence a single-layer electrode structure or a three or more-layer electrode structure may also be adopted for the control electrodes.

The guard electrode 30 is a sheet-like electrode common to all the discharge portions, and, as shown in FIG. 2A, has ring-like opening portions which are formed in positions corresponding to the first and second control electrodes 26 and 28 which are formed in the peripheries of the through holes 38 of each of the discharge portions. The surface of the insulating layer 34 and an upper surface of the guard electrode 30 are covered with the insulating layer 36 for protecting these surfaces to obtain a flattened surface. A predetermined voltage is applied to the guard electrode 30 and hence it plays a function of suppressing an electric field interference generated between the ink guides 16 of the adjacent discharge portions.

Note that the guard electrode 30 is not an essential constituent element. In addition, in order to shield a repulsion electric field in a direction from the first control electrodes 26 or the second control electrodes 28 to the ink passage 48, the discharge opening substrate 14 may be provided with a shielding electrode which is formed on a side of the ink passage 48 with respect to the second control electrode 28.

Next, the ink guide 16 is a flat plate which is made of ceramics having a predetermined thickness and which has the convex tip portion 17. Then, the ink guides 16 of the five discharge portions disposed in the same row are disposed at the predetermined intervals on the same supporting body 50 disposed on the floating conductive plate 22 on the head substrate 12. The ink guide 16 extends through the through hole 38 bored through the discharge opening substrate 14, and its tip portion 17 projects upwardly from the uppermost surface of the discharge opening substrate 14 on the recording medium P side (corresponding to the upper surface of the insulating layer 36 in FIGS. 1A and 1B).

The ink guide tip portion 17 is formed into nearly a triangle (or a trapezoid) which tapers off towards the counter electrode 18 side. A metal material is preferably evaporated onto the ink guide tip portion (the highest tip portion) 17. The evaporation of the metal material onto the ink guide tip portion 17 is not an essential factor. However, the evaporation of the metal offers an effect that a permittivity of the ink guide tip portion 17 substantially increases to facilitate the generation of a strong electric field.

Note that the shape of the ink guide 16 is not especially limited as long as the charged fine particles contained in the ink Q can be made to pass through the through hole 38 of the discharge opening substrate 14 to be concentrated at the tip portion 17. For example, the ink guide tip portion 17 does not necessarily have the convex shape. Thus, the ink guide tip portion 17 may be freely changed. In addition, in order to promote the concentration of the charged fine particles at the ink guide tip portion 17, a cutout serving as an ink guide groove through which the ink Q is collected at the ink guide tip portion 17 by the capillary phenomenon may be formed vertically at the central portion of the ink guide 16 in the figure.

Next, the counter electrode 18 is disposed in a position facing the ink guide tip portion 17 at a predetermined distance (e.g., 200 to 1,000 μm) from the ink guide tip portion 17. The counter electrode 18 includes an electrode substrate 40 and an insulating sheet 42. The electrode substrate 40 is grounded, and the insulating sheet 42 is formed on a surface of the electrode substrate 40 on the ink guide 16 side. The recording medium P is held on the surface of the insulating sheet 42, and the counter electrode (the insulating sheet 42) 18 functions as the platen of the recording medium P.

The charging unit 20 for the recording medium P includes a scorotron charging unit 44 for charging the recording medium P at a negative high voltage, and a bias voltage source 46 for supplying a negative high voltage to the scorotron charging unit 44. The scorotron charging unit 44 is disposed in a position facing the surface of the recording medium P at a predetermined distance from the surface of the recording medium P. In addition, a negative side terminal of the bias voltage source 46 is connected to the scorotron charging unit 44, and a positive side terminal of the bias voltage source 46 is grounded.

Note that the charging means of the charging unit 20 is not limited to the scorotron charging unit 44, and thus it is possible to use various charging means such as a corotron charging unit or a solid charger.

In recording an image, the surface of the insulating sheet 42 of the counter electrode 18, i.e., the recording medium P held thereon is charged at a predetermined negative high voltage opposite in polarity to the high voltage applied to the first control electrode 26 or the second control electrode 28, e.g., at −1.5 kV by the charging unit 20. As a result, the recording medium P is usually biased by the charging unit 20 at a negative high voltage as compared with the first control electrode 26 or the second control electrode 28 and hence is electrostatically adsorbed on the insulating sheet 42 on the counter electrode 18.

Note that while the counter electrode 18 is constituted by the electrode substrate 40 and the insulating sheet 42, and the recording medium P is charged at the negative high voltage by the charging unit 20 to be electrostatically adsorbed on the surface of the insulating sheet 42, the present invention is not limited to this constituent. That is to say, there may be adopted a constitution that the counter electrode 18 is constituted by only the electrode substrate 40, the counter electrode (the electrode substrate 40 itself) 18 is connected to the bias voltage source 46 to be usually biased at a negative high voltage, and under this condition, the recording medium P is electrostatically adsorbed on the surface of the counter electrode 18.

In addition, the electrostatic adsorption of the recording medium P on the counter electrode 18, and the electrostatic charge of the recording medium P at a negative high voltage, or the application of a negative bias high voltage to the counter electrode 18 may also be carried out using different negative high voltage sources. Also, the means for supporting the recording medium P by the counter electrode 18 is not limited to the electrostatic adsorption of the recording medium P, and hence any other suitable supporting method or support means may also be used for the recording medium P.

In the foregoing description, the method for driving the first and second control electrodes 26 and 28 has been described by giving the specific example in which the ink jet head includes the fifteen discharge portions. However, it should be noted that the number of discharge portions, the physical disposition of the discharge portions, and the like may be freely selected. For example, it is possible to one-dimensionally or two-dimensionally dispose a plurality of discharge portions to constitute the line head. In addition, the head units, the number of which corresponds to the number of used ink colors are provided to thereby be able to cope with the monochrome recording and the color recording.

Next, the structure in the vicinity of the through hole (the discharge opening for the ink) 38 becoming a characteristic portion of the present invention will be described.

Figure 3A:
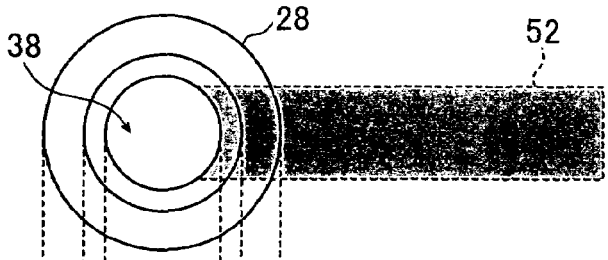
FIGS. 3A and 3B are a structural plan view and a structural cross sectional view each showing a structure in the vicinity of a through hole of a discharge opening substrate according to an embodiment.
Figure 3B:
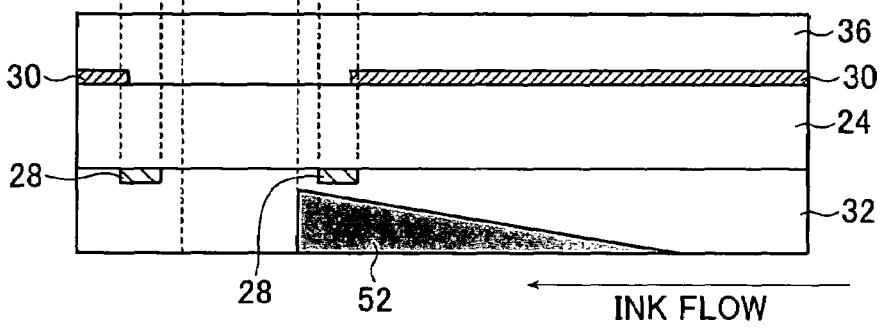

FIGS. 3A and 3B are a structural plan view and a structural cross sectional view each showing a structure in the vicinity of the through hole of the discharge opening substrate according to an embodiment. Those figures each show the structure in the vicinity of the through hole (discharge opening) 38 of the discharge opening substrate 14 of the ink jet head 11 shown in FIGS. 1A and 1B. However, for the sake of easiness of the description, the illustration of the first control electrode 26 and the insulating layer 34 is omitted here, and only the insulating substrate 24, the second control electrode 28, the guard electrode 30, and the insulating layers 32 and 36 are shown.

As shown in FIGS. 3A and 3B, an ink guide groove 52 is formed in the surface of the discharge opening substrate 14 on the ink passage 48 side, i.e., in the surface of the insulating layer 32 on the ink passage 48 side so as to lead from the upstream side of the ink flow to the through hole 38. In addition, the ink guide groove 52 is sloped at a predetermined angle so that its depth becomes gradually deeper from the upstream side of the ink flow to the through hole 38. While not illustrated, the ink guide grooves 52 are provided near the through holes 38 of the discharge portions, respectively.

In such a manner, the ink guide groove 52 leading to the discharge opening 38 is provided to guide the ink Q into the discharge opening 38 along the ink guide groove 52. Hence, it is possible to enhance the property of supply of the ink to the discharge opening (the ink guide tip portion 17). Consequently, the responsibility to the discharge frequency in recording an image is improved, and thus even when the dots are continuously drawn at a high speed, the dots each having a desired size can be stably drawn.

It is desired that the discharge frequency of 5 kHz if a time period required to output an image is considered, preferably at a discharge frequency of 10 kHz, and more preferably at a discharge frequency of 15 kHz.

For example, in a case where a thickness of the discharge opening substrate 14 is 450 μm, when no ink guide groove 52 is formed, the dots which have a dot diameter of 16 μm (corresponding to 2,400 dpi), a dot diameter of 20 μm (corresponding to 1,800 dpi), and a dot diameter of 32 μm (corresponding to 1,200 dpi) can be stably drawn at the discharge frequency of 5 kHz.

On the other hand, when the ink guide groove 52 is formed, the dots which have a dot diameter of 16 μm (corresponding to 2,400 dpi), a dot diameter of 20 μm (corresponding to 1,800 dpi), and a dot diameter of 32 μm (corresponding to 1,200 dpi) can be stably drawn at each of the discharge frequencies of 5 kHz, 10 kHz, and 15 kHz.

Figure 3C:
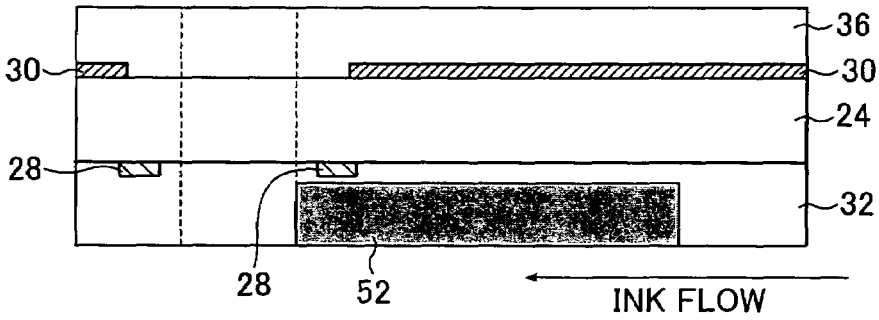
FIG. 3C is a structural cross sectional view showing a structure in the vicinity of the through hole of the discharge opening substrate shown in FIG. 3B according to another embodiment.

As shown in FIG. 3C, the ink guide groove 52 may be formed in a fixed depth along the ink flow direction. In this case, the flow of the ink supplied from the ink passage 48 to the inside of the ink guide groove 52 becomes temporarily a turbulent flow owing to a difference in level between the surface of the insulating layer 32 and a bottom surface of the ink guide groove 52. Thus, in order to change this turbulent flow into a commutated flow, a length of the ink guide groove 52 (a length in the ink flow direction) is preferably made 6 or more times as large as the depth of the ink guide groove 52, and more preferably is made 8 or more times as large as the depth of the ink guide groove 52.

In addition, in each of the embodiments shown in FIGS. 3A and 3B, and 3C, the second control electrode 28 is formed in a ring-like shape so as to surround the periphery of the through hole 38. Hence, the ink guide groove 52 can not be formed so as to extend in depth beyond the second control electrode 28. On the other hand, as shown in FIGS. 4A to 4C, the second control electrode 28 is formed into a circular shape with its part being removed, whereby the ink guide groove 52 can be formed so as to extend in depth beyond the second control electrode 28.

Figure 4A:
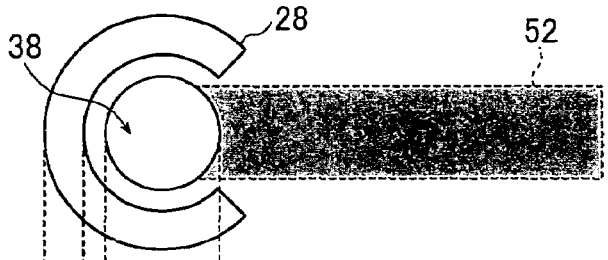
FIGS. 4A and 4B are a structural plan view and a structural cross sectional view each showing a structure in the vicinity of a through hole of a discharge opening substrate according to still another embodiment.
Figure 4B:
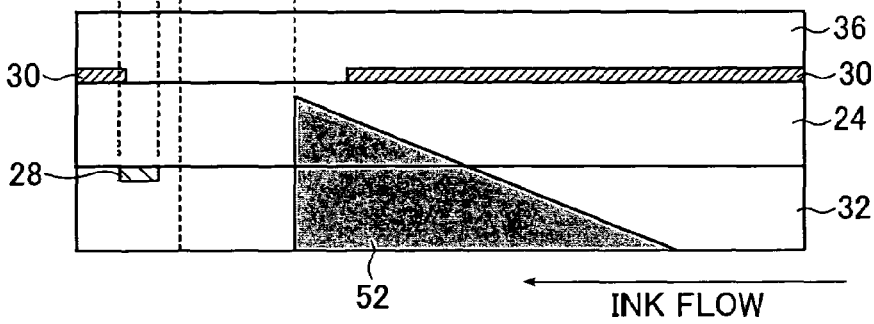
Figure 4C:
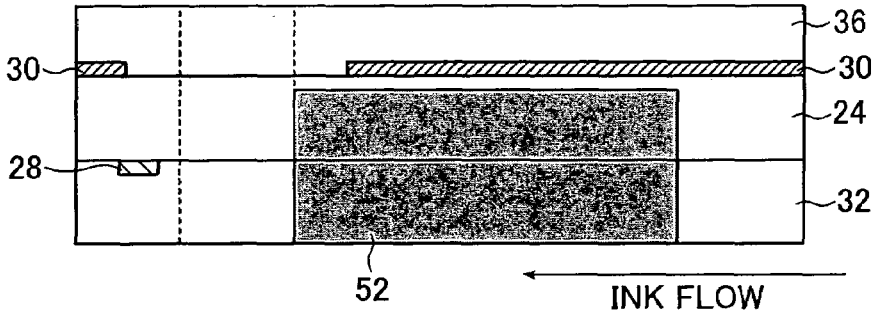
FIG. 4C is a structural cross sectional view showing a structure in the vicinity of the through hole of the discharge opening substrate shown in FIG. 4B according to yet another embodiment.
Figure 5A:
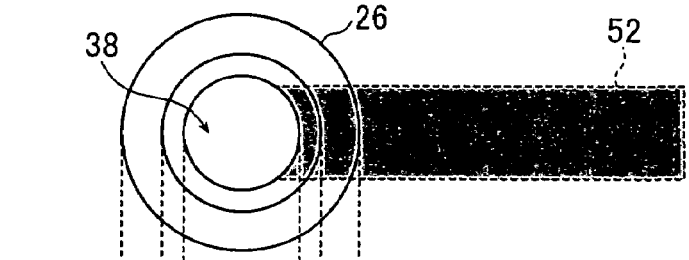
FIGS. 5A and 5B are a structural plan view and a structural cross sectional view each showing a structure in the vicinity of a through hole of a discharge opening substrate according to a further embodiment.
Figure 5B:
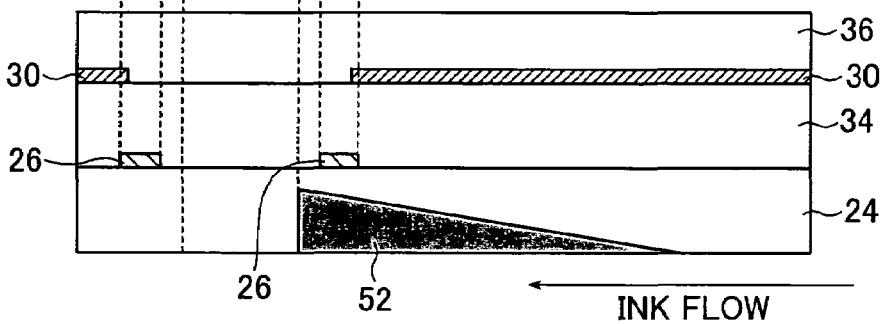
Figure 5C:
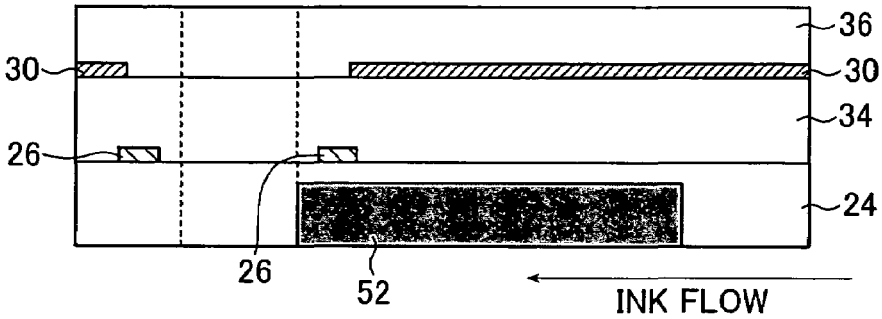
FIG. 5C is a structural cross sectional view showing a structure in the vicinity of the through hole of the discharge opening substrate shown in FIG. 5B according to an even further embodiment.
Figure 6A:
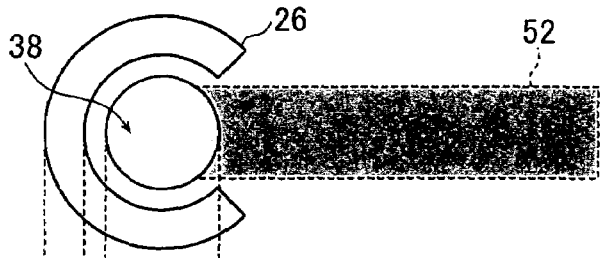
FIGS. 6A and 6B are a structural plan view and a structural cross sectional view-each showing a structure in the vicinity of a through hole of a discharge opening substrate according to another embodiment.
Figure 6B:
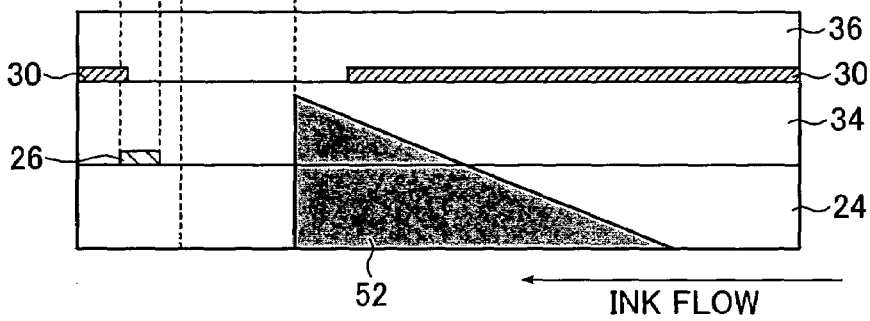
Figure 6C:
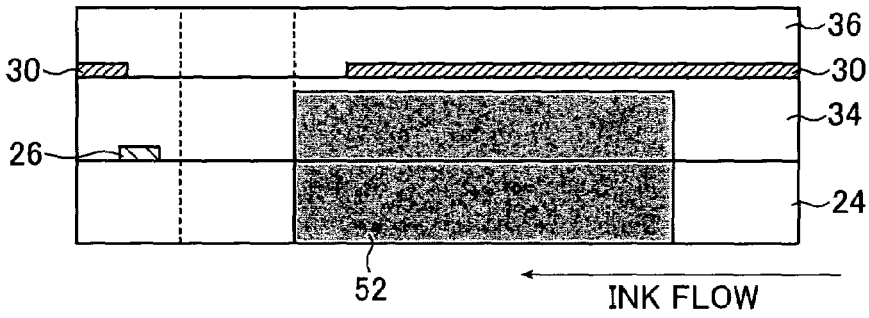
FIG. 6C is a structural cross sectional view showing a structure in the vicinity of the through hole of the discharge opening substrate shown in FIG. 6B according to an additional embodiment.

FIGS. 4A to 4C correspond to FIGS. 3A to 3C each showing the structure in the vicinity of the through hole 38 of the discharge opening substrate 14. In a case of each of the embodiments shown in FIGS. 4A, 4B and 4C, the second control electrode 28 is formed into a circular arc shape with its part on the upstream side of the ink flow being removed. Thus, the ink guide groove 52 is formed so as to extend through a removed portion of the second control electrode 28 to reach in depth the insulating substrate 24.

In such a manner, the ink guide groove 52 can be deeply formed to thereby further enhance the property of supply of the ink to the discharge opening.

Note that while the length, width, depth, plan shape, cross sectional shape, and the like of the ink guide groove 52 are not limited at all, however, since the property of supply of the ink to the discharge opening changes in correspondence to these settings, these factors are preferably and suitably set as may be necessary.

For example, as described above, when the ink guide groove 52 is formed without being sloped, the length of the ink guide groove 52 is preferably made 6 or more times as large as the depth of the ink guide groove 52. On the other hand, when the ink guide groove 52 is formed with being sloped, there is an advantage that the length of the ink guide groove 52 can be made shorter than that when the ink guide groove 52 is formed without being sloped since it is possible to reduce occurrence of the turbulent flow of the ink flow.

In addition, the width of the ink guide groove 52 is preferably, approximately equal to the diameter of the though hole 38. However, even if the width of the ink guide groove 52 is slightly larger than the diameter of the through hole 38, or is slightly smaller than the diameter of the through hole 38, the property of supply of the ink can be surely enhanced as compared with the case where no ink guide groove 52 is formed.

As in a case of each of the embodiments shown in FIGS. 4A, 4B and 4C rather than a case of each of the embodiments shown in FIGS. 3A, 3B and 3C, the ink guide groove 52 is preferably deeper.

Figure 7A:
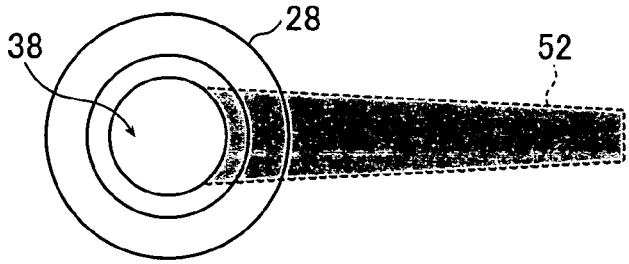
FIGS. 7A and 7B are structural plan views showing a structure in the vicinity of a through hole of a discharge opening substrate according to another embodiment, respectively.
Figure 7B:
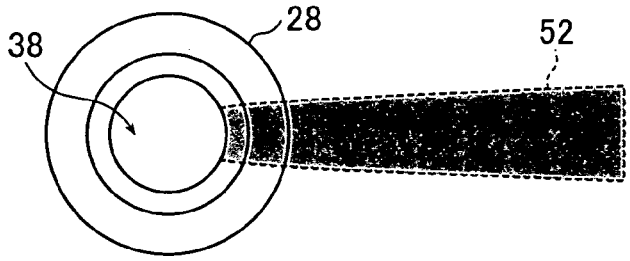
Figure 8A:
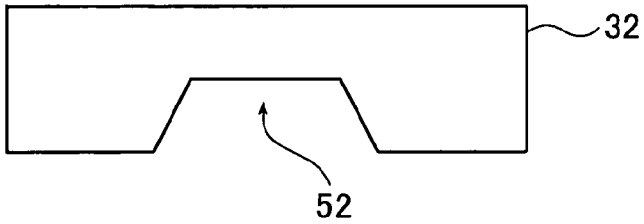
FIGS. 8A and 8B are structural cross sectional views showing cross sectional shapes of an ink guide groove, respectively.
Figure 8B:
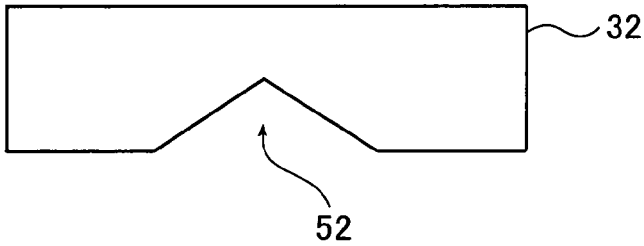

With respect to the shape of the ink guide groove 52, as shown in each of the above-mentioned embodiments, the width of the ink guide groove 52 is uniform in the direction of the ink flow. As shown in FIG. 7A, the ink guide groove may taper off in width towards the upstream side of the ink flow, or as shown in FIG. 7B, the ink guide groove may taper off in width towards the through hole 38 side. In addition, as shown in FIGS. 8A and 8B, the cross sectional shape of the ink guide groove 52 is preferably a trapezoidal shape or an inverted triangular shape in which its width becomes narrower as its depth becomes deeper (as a depth level approaches a bottom surface).

Figure 9:
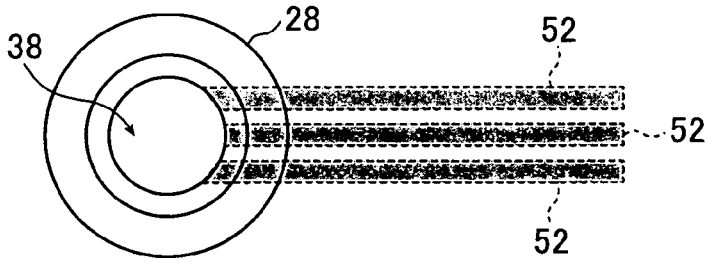
FIG. 9 is a structural plan view showing a structure in the vicinity of a through hole of a discharge opening substrate according to yet another embodiment.
Figure 10:
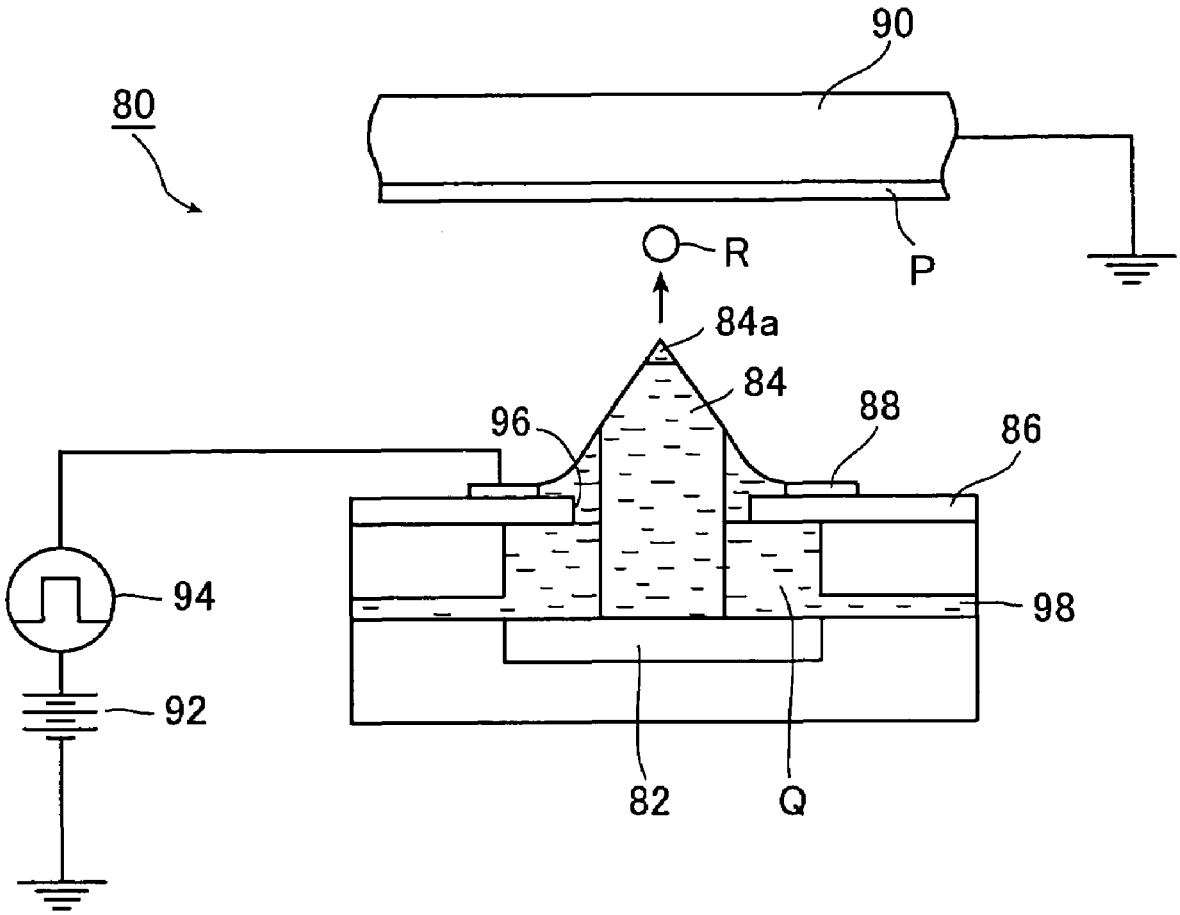
FIG. 10 PRIOR ART
FIG. 10 is a structural schematic view of an example of a conventional ink jet head.

In addition, only one ink guide groove 52 may be adopted, or as shown in FIG. 9 as an example, a plurality of grooves leading to the through hole 38 may also be formed. Also, while in FIGS. 3A to 3C, and FIGS. 4A to 4C, the electrodes and the insulating layers are formed sequentially on the front and rear surfaces of the insulating substrate 24 to thereby obtain the lamination structure, the lamination means for the discharge opening substrate 14 is not also limited at all. Thus, as shown in FIGS. 5A to 5C, and FIGS. 6A to 6C, the ink guide groove 52 can be satisfactorily used even in the discharge opening substrate 14 having the lamination structure in which the electrodes and the insulating layers are formed sequentially on the surface of the insulating substrate 24.

Also, the means for forming the ink guide groove 52 is not limited at all. Hence, various digging means such as dicing, laser processing, sand blasting, or the like can be utilized in correspondence to the materials of the discharge opening substrate 14.

Next, a description will hereinafter be given with respect to the ink Q used in the ink jet recorder 10.

A liquid material in which colored and charged particles (colored and charged fine particles) each having a particle diameter of about 0.1 to about 5.0 μm are dispersed into a carrier liquid is used as the ink Q. Note that disperse resin particles for enhancing the fixing property of an image after printing may be suitably contained in the ink Q. In addition, the carrier liquid is preferably a dielectric liquid (nonaqueous solvent) having a high electrical resistivity (equal to or larger than $10^9$ Ω·cm, preferably equal to or larger than $10^{10}$ Ω·cm, and preferably equal to or smaller than $10^{16}$ Ω·cm).

When the dielectric liquid having a high electrical resistivity is used as the carrier liquid, it is possible to reduce that the carrier liquid itself suffers the injection of the electric charges due to the applied voltage to the control electrode, and hence it is possible to concentrate the charged particles. In addition, the carrier liquid having a high electrical resistivity may contribute prevention of the electrical conduction between the adjacent discharge portions. Also, when the ink containing the carrier liquid having the electrical resistivity falling within the above-mentioned range is used, the ink can be satisfactorily discharged even in the low electric field.

In addition, a relative permittivity of the carrier liquid is preferably equal to or smaller than 5, more preferably equal to or smaller than 4, and much more preferably equal to or smaller than 3.5. Its lower limit is desirably about 1.9. Such a range is selected for the relative permittivity of the carrier liquid, whereby the electric field effectively acts on the charged particles in the dielectric liquid to cause the charged particles to be easy to migrate. As a result, the polarization of the solvent can be suppressed to allow relaxation of the electric field to be suppressed. Thus, it is possible to form the dot which has satisfactory image concentration and which is less in bleeding.

As for the carrier liquid, preferably, it is possible to use straight chain or branch chain aliphatic hydrocarbon and alicyclic hydrocarbon, aromatic hydrocarbon, a halogen substitution product of these hydrocarbons, and the like.

More specifically, as the carrier liquid, for example, it is possible to singly or mixedly use hexane, heptane, octane, isooctane, decane, isodecane, decalin, nonane, dodecane, isododecane, cyclohexane, cyclooctane, cyclodecane, benzene, toluene, xylene, mesitylene, isopar C, isopar E, isopar G, isopar H, isopar L (isopar: a trade name of a liquid material made by EXXON MOBILE CORPORATION), shellsol 70, shellsol 71 (shellsol: a trade name of a liquid material made by SHELL OIL CO., LTD.), amsco OMS solvent, amsco 460 solvent (amsco: a trade name of a liquid material made by SPIRITS CO., LTD.), silicone oil (e.g., KF-96L made by SHIN-ETSU CHEMICAL CO., LTD.) or the like.

With respect to the colored particles, the coloring material may be directly dispersed into a dielectric liquid, or may be indirectly dispersed into a dielectric liquid after being contained in disperse resin particles for enhancement of fixing property. In the case where the coloring material is contained in the disperse resin particles, in general, there is adopted a method in which the pigments or the like are covered with the resin material of the disperse resin particles to obtain the particles covered with the resin, and the disperse resin particles are colored with the dyes or the like to obtain the colored particles. In addition, as for the coloring material, all the ink composite for ink jet, the (oiliness) ink composite for printing, or the pigments and dyes used in the liquid developer for electrostatic photography may be used.

In addition, a content of colored particles (a total content of coloring particles and resin particles) preferably falls within a range of 0.5 to 30.0 weight % for the overall ink from a viewpoint of concentration of the printed image, formation of uniform disperse liquid, and suppression of clogging of the ink in the discharge heads, more preferably falls within a range of 1.5 to 25.0 weight %, and much more preferably falls within a range of 3 to 20 weight %.

As for the pigment used as the coloring material, ones which are generally used in the technical field of the printing may be used herein irrespective of the inorganic pigment or the organic pigment.

More specifically, as for the pigment used as the coloring material, various pigments such as carbon black, cadmium red, molybdenum red, chromium yellow, cadmium yellow, titanium yellow, chromium oxide, vyridian, cobalt green, ultramarine blue, pursian blue, cobalt blue, azo series pigments, phthalocyanine series pigments, quinacridone series pigments, isoindolinone series pigments, dioxazin series pigments, indanthrene series pigments, perylene series pigments, perynone series pigments, thioindigo series pigments, quinophthalone series pigments, and a metallic complex pigment, or the like can be used without being especially limited.

In addition, as for the dye used as the coloring material, there is preferable an oil soluble dye such as an azodye, a metal complex dye, a naphthol dye, an anthraquinone dye, an indigo dye, a carbonium dye, a quinonimine dye, a xanthene dye, an aniline dye, a quinoline dye, a nitro dye, a nitroso dye, a penzoquinone dye, a naphthoquinone dye, a phthalocyanine dye, or a metal phthalocyanine dye.

Also, an average particle diameter of the colored particles preferably falls within a range of 0.1 to 5.0 μm, more preferably falls within a range of 0.2 to 1.5 μm, and much more preferably falls within a range of 0.4 to 1.0 μm. These particle diameters are measured with CAPA-500 (a trade name of a measuring apparatus manufactured by HORIBA LTD.).

Note that the colored particles in the ink Q are preferably the charging detectable particles which are positively or negatively charged. Giving the colored particles the charging detectability can be realized by suitably utilizing the technique of the developer for wet electrostatic photography. More specifically, giving the colored particles the charging detectability is attained by using the charging detectable materials described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY—BASES AND APPLICATIONS", edited by THE IMAGING SOCIETY OF JAPAN, and published by CORONA PUBLISHING CO., LTD., pp 497 to 505, 1988; and "ELECTRONIC PHOTOGRAPHY", by Yuji Harasaki, 16(No. 2), p.44, 1977, and other addition agents.

In addition, the viscosity of the ink composite is preferably in a range of 0.5 to 5.0 mPa·sec, more preferably in a range of 0.6 to 3.0 mPa·sec, and much more preferably in a range of 0.7 to 2.0 mPa·sec. The colored particles are charged, and various charging control agents which are used in the liquid developer for electronic photograph as may be necessary can be used therein. A charging amount thereof is preferably in a range of 5 to 200 μC/g, more preferably in a range of 10 to 150 μC/g, and much more preferably in a range of 15 to 100 μC/g.

The electrical resistance of the dielectric liquid may be changed by adding the charging control agent in some cases. Thus, a distribution factor P defined below is preferably equal to or larger than 50%, more preferably equal to or larger than 60%, and much more preferably equal to or larger than 70%.

$$P=100\times(\sigma 1-\sigma 2)/\sigma 1$$

where $\sigma 1$ is an electric conductivity of an ink composite, and $\sigma 2$ is an electric conductivity of a supernatant liquid which is obtained by inspecting the ink composite with a centrifugal separator.

These electric conductivities were obtained by measuring the electric conductivities of the ink composite and the supernatant liquid under a condition of an applied voltage of 5 V and a frequency of 1 kHz using an LCR meter of an AG-4311 type (manufactured by ANDO ELECTRIC CO., LTD). and an electrodes for liquids of an LP-05 type (manufactured by KAWAGUCHI ELECTRIC WORKS, CO., JP). In addition, the centrifugation was carried out for 30 minutes under a condition of a rotational speed of 14,500 rpm and a temperature of 23° C. using a miniature high speed cooling centrifugal machine of an SRX-201 type (manufactured by TOMY SEIKO CO., LTD.).

The ink composite as described above is adopted, which results in that the colored and charged particles become easy to migrate and hence the colored and charged particles become easy to be concentrated.

On the other hand, the electric conductivity $\sigma 1$ of the ink composite is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the control electrodes are not excessively high, and also there is no anxiety to cause the electrical conduction between the adjacent recording electrodes.

In addition, a surface tension of the ink composite is preferably in a range of 15 to 50 mN/m, more preferably in a range of 15.5 to 45.0 mN/m, and much more preferably in a range of 16 to 40 mN/cm. The surface tension is set to this range, resulting in that the applied voltages to the control electrodes are not excessively high, and also the ink does not leak and spread to the periphery of the head to contaminate the head.

The ink jet head 11 does not apply a force to the overall ink to fly the ink droplet R towards the recording medium P, but applies a force to the charged fine particles dispersed into a carrier liquid to fly the ink droplet R towards the recording medium P. As a result, an image can be recorded on various recording media such as not only a plain paper but also a non-absorption film, e.g., a PET film. In addition, an image of high image quality can be recorded on various recording media without running and flowing thereon.

Next, an operation of the electrostatic type ink jet recorder 10 will be described based on an example of a case where the colored fine particles contained in the ink Q are positively charged.

In recording an image, the ink Q is made to circulate through the ink passage 48 from the right-hand side to the left-hand side in FIG. 1B (in a direction indicated by an arrow a in FIG. 1B) at a predetermined velocity by a circulation mechanism for ink (not shown).

At this time, the charged fine particles contained in the ink Q within the ink passage 48 are energized by the floating conductive plate 22 to pass through the through hole 38 to be concentrated at the tip portion of the ink guide 16. Thus, the colored fine particles positively charged within the ink Q are usually stabilized at predetermined concentration. In addition, since the ink Q is guided into the inside of the through hole 38 along the ink guide groove 52, it is possible to enhance the property of supply of the ink to the discharge opening (the ink guide tip portion 17).

On the other hand, the recording medium P is charged at a negative high voltage (e.g., at −1.5 kV) by the charging unit 20, and is carried to an inner portion side of the paper in FIGS. 1A and 1B at a predetermined velocity by carry means (not shown) while being electrostatically adsorbed on the insulating sheet 42 on the counter electrode 18.

The second control electrodes 28 are set at a high voltage level (e.g., at 400 to 600 V) or in a high impedance state (in an ON state) in order one row by one row by the control means, and all the remaining second control electrodes 28 are driven at the ground level (the ground state, i.e., in an OFF state). On the other hand, the first control electrodes 26 are simultaneously driven in each of all columns at a high voltage level or at the ground level in correspondence to the image data. As a result, the discharge/non-discharge of the ink in each of the discharge portions is controlled.

That is to say, when the second control electrode 28 is at the high voltage level or in the high impedance state, and also the first control electrode 26 is at the high voltage level, the ink Q is discharged in the form of the ink droplet R. On the other hand, when at least one of the first and second control electrodes 26 and 28 is at the ground level, no ink is discharged. Then, the ink droplets R discharged from the respective discharge portions are attracted to the recording medium P charged at the negative high voltage to be stuck onto predetermined positions on the recording medium P, respectively, to form an image.

At this time, as described above, the provision of the ink guide groove 52 leading to the through hole 38 enhances the property of supply of the ink to the discharge opening. For this reason, the responsibility to the discharge frequency in recording an image is improved. Thus, even when the dots are continuously drawn at a high speed, it is possible to suppress reduction of the dot diameter, and hence it is possible to stably draw the dots each having a desired size. In other words, it is possible to record an image of high image quality having no dispersion in dot sizes.

At that, as described above, when the rows of the second control electrodes 28 as the lower layer are successively turned ON, and the first control electrodes 26 as the upper layer are turned ON/OFF in correspondence to the image data, the first control electrodes 26 are driven in correspondence to the image data. Thus, when the individual discharge portions in the column direction are supposed to be the centers, in the discharge portions on the both sides of each central discharge portion, the levels of the first control electrodes 26 are changed frequently to the high voltage level or to the ground level. In this case, the guard electrode 30 is biased at a predetermined guard potential, e.g., at the ground level or the like in recording an image, thereby excluding influences of electric fields of the adjacent discharge openings.

In addition, as another embodiment, the first and second control electrodes 26 and 28 can also be driven in opposite states. That is, the first control electrodes 26 can be successively driven one column by one column, and the second control electrodes 28 can be driven in correspondence to the image data.

In this case, with respect to the column direction, the first control electrodes 26 are driven one column by one column, and when the individual discharge portions in the column direction are supposed to be the centers, the first control electrodes 26 of the discharge portions on the both sides of each central discharge portion in the column direction usually become the ground level. Thus, the first control electrodes 26 of the discharge portions on the both sides of each central discharge portion in the column direction function as the guard electrode 30. In the case where the first control electrodes 26 as the upper layer are successively turned ON one column by one column, and the second control electrodes 28 as the lower layer are driven in correspondence to the image data, even if no guard electrode 30 is provided, the influences of the adjacent discharge portions can be excluded to enhance the recording quality.

In the ink jet head 11, whether the control for the ink discharge/non-discharge is carried out using one of or both of the first control electrodes 26 and the second control electrodes 28 is not a limiting factor at all. That is to say, the voltages of the control electrode side and the recording medium P side have to be suitably set so that when a difference between the voltage value of the control electrode side during the ink discharge/non-discharge, and the voltage value of the recording medium P side is larger than a predetermined value, the ink is discharged, while when the difference is smaller than the predetermined value, no ink is discharged.

In addition, while in each of the above-mentioned embodiments, the colored fine particles contained in the ink are positively charged, and the recording medium P side is charged at a negative high voltage, the present invention is not limited thereto. That is to say, conversely, the colored fine particles in the ink may be negatively charged, and the recording medium P side may be charged at a positive high voltage. In such a manner, when the polarity of the colored fine particles is reversed to that of the colored fine particles in each of the above-mentioned embodiments, the polarities or the like of the applied voltages to the counter electrode 18, the charging unit 20 for the recording medium P, and the first and second control electrodes 26 and 28 of each of the discharge portions have to be reversed to those in each of the above-mentioned embodiments.

Though the concrete overall construction of the ink jet recorder of the present invention is not illustrated, the ink jet recorder of the present invention serves to record an image corresponding to image data on a recording medium using the ink jet head of the present invention.

Note that the present invention is not limited to the electrostatic type ink jet head and the electrostatic type ink jet recorder, and hence can be applied to various ink jet heads and ink jet recorders using the discharge control means for ink, such as the thermal type one and the piezo type one.

The present invention is basically as described above.

While above, the ink jet head and the ink jet recorder of the present invention have been described in detail, it is to be understood that the present invention is not limited to the above-mentioned embodiments, and hence various improvements and changes may be made without departing from the subject matter of the present invention.

As set forth in detail hereinabove, according to the present invention, since the ink guide groove leading to the discharge opening is formed to allow the ink to be guided to the inside of the discharge opening along the ink guide groove, it is possible to enhance the property of supply of the ink to the discharge opening. Consequently, the responsibility at the discharge frequency in recording an image is improved, and hence even when the dots are continuously drawn at a high speed, it is possible to suppress reduction of the dot diameter. As a result, it is possible to stably draw the dots each having a desired size.

What is claimed is:

1. An ink jet head for discharging ink containing colored fine particles to record an image corresponding to image data on a recording medium, the ink jet head comprising:

a discharge opening substrate through which discharge openings are bored, said ink being discharged through said discharge openings;

a head substrate disposed at a predetermined distance from said discharge opening substrate so as to define an ink passage between said discharge opening substrate and said head substrate; and discharge control means for controlling the discharge of said ink through said discharge openings, wherein an ink guide groove is formed in a surface of said discharge opening substrate on a side of said ink passage so as to be directed from an upstream side of an ink flow to said discharge opening along the ink flow so that the ink flowing in the ink passage towards the discharge openings is guided by the ink guide groove.

2. The ink jet head according to claim 1, wherein said ink jet head is an electrostatic type ink jet head for discharging ink containing charged and colored fine particles by utilizing an electrostatic force to record said image corresponding to image data on said recording medium, said discharge opening substrate includes at least: an insulating substrate; a ring-like control electrode of at least one layer formed on a surface of said insulating substrate on a side of said ink passage and/or a side of said recording medium so as to surround a periphery of said discharge opening; and an insulating layer of at least one layer for covering surfaces of said insulating substrate and said control electrode, and said ink guide groove is formed in the surface of said discharge opening substrate on the side of said ink passage.

3. The ink jet head according to claim 2, wherein said control electrode is formed into a circular arc shape with its part on the upstream side of said ink flow being removed, and said ink guide groove is formed so as to extend through said removed portion of said control electrode to reach in depth the layer on a side of said recording medium through the control electrode formed nearest the side of said recording medium.

4. The ink jet head according to claim 1, wherein said ink guide groove is sloped at a predetermined angle so that its depth becomes gradually deeper from the upstream side of said ink flow to said discharge opening.

5. The ink jet head according to claim 1, wherein a length of said ink guide groove is 6 or more times as large as the depth of said ink guide groove.

6. The ink jet head according to claim 1, wherein said ink guide groove is formed so that its width becomes nearly equal to a diameter of said discharge opening, or becomes narrower towards the upstream side of said ink flow, or becomes narrower towards said discharge opening.

7. The ink jet head according to claim 1, wherein said ink guide groove is formed so that its depth becomes gradually narrower in cross sectional shape as its depth becomes deeper.

8. The ink jet head according to claim 1, wherein said ink guide groove is constituted by a plurality of grooves formed so as to lead to said discharge opening.

9. An ink jet recorder using an ink jet head for discharging ink containing colored fine particles to record an image corresponding to image data on a recording medium, wherein said ink jet head includes:

a discharge opening substrate through which discharge openings are bored, said ink being discharged through said discharge openings;

a head substrate disposed at a predetermined distance from said discharge opening substrate so as to define an ink passage between said discharge opening substrate and said head substrate; and discharge control means for controlling the discharge of said ink through said discharge openings, and wherein an ink guide groove is formed in a surface of said discharge opening substrate on a side of said ink passage so as to be directed from an upstream side of an ink flow to said discharge opening along the ink flow so that the ink flowing in the ink passage towards the discharge openings is guided by the ink guide groove.

10. The ink jet recorder according to claim 9, wherein said ink jet head is an electrostatic type ink jet head for discharging ink containing charged and colored fine particles by utilizing an electrostatic force to record said image corresponding to image data on said recording medium, said discharge opening substrate includes at least: an insulating substrate; a ring-like control electrode of at least one layer formed on a surface of said insulating substrate on a side of said ink passage and a side of said recording medium so as to surround a periphery of said discharge opening; and an insulating layer of at least one layer for covering surfaces of said insulating substrate and said control electrode, and said ink guide groove is formed in the surface of said discharge opening substrate on the side of said ink passage.

11. The ink jet recorder according to claim 10, wherein said control electrode is formed into a circular arc shape with its part on the upstream side of said ink flow being removed, and said ink guide groove is formed so as to extend through said removed portion of said control electrode to reach in depth the layer on a side of said recording medium through the control electrode formed nearest the side of said recording medium.

12. The ink jet recorder according to claim 9, wherein said ink guide groove is sloped at a predetermined angle so that its depth becomes gradually deeper from the upstream side of said ink flow to said discharge opening.

13. The ink jet recorder according to claim 9, wherein a length of said ink guide groove is 6 or more times as large as the depth of said ink guide groove.

14. The ink jet recorder according to claim 9, wherein said ink guide groove is formed so that its width becomes nearly equal to a diameter of said discharge opening, or becomes narrower towards the upstream side of said ink flow, or becomes narrower towards said discharge opening.

15. The ink jet recorder according to claim 9, wherein said ink guide groove is formed so that its depth becomes gradually narrower in cross sectional shape as its depth becomes deeper.

16. The ink jet recorder according to claim 9, wherein said ink guide groove is constituted by a plurality of grooves formed so as to lead to said discharge opening.

* * * * *